US005697423A

United States Patent [19]

Roder et al.

[11] Patent Number: 5,697,423

[45] Date of Patent: Dec. 16, 1997

[54] APPARATUS FOR CONTINUOUSLY CASTING

[75] Inventors: Rudolf Roder; Marcel Witschi, both of Thun, Switzerland

[73] Assignee: Lauener Engineering, Ltd., Golden, Colo.

[21] Appl. No.: 221,213

[22] Filed: Mar. 30, 1994

[51] Int. Cl.[6] ..... B22D 11/06; B22D 11/22

[52] U.S. Cl. ..... 164/414; 164/154.7; 164/158; 164/430; 164/443

[58] Field of Search ..... 164/121, 151.4, 164/154.7, 158, 414, 430, 431, 443, 455, 479, 480, 481, 485

[56] References Cited

U.S. PATENT DOCUMENTS

| | | | |
|---|---|---|---|
| 3,478,808 | 11/1969 | Adams . | |
| 3,570,583 | 3/1971 | Lauener . | |
| 3,570,586 | 3/1971 | Lauener . | |
| 3,626,479 | 12/1971 | Properzi . | |
| 3,795,269 | 3/1974 | Leconte et al. | 164/421 X |
| 3,865,176 | 2/1975 | Dompas et al. | 164/481 |
| 4,235,276 | 11/1980 | Gilles et al. | 164/455 |
| 4,425,411 | 1/1984 | Textor et al. | 428/702 |
| 4,625,788 | 12/1986 | Buxmann et al. | 164/481 |
| 4,660,619 | 4/1987 | Nettelbeck et al. | 164/455 |
| 4,674,555 | 6/1987 | Plata | 164/150 |
| 4,674,556 | 6/1987 | Sakaguchi et al. | 164/414 X |
| 4,807,692 | 2/1989 | Tsuchida | 164/430 |
| 4,934,444 | 6/1990 | Frischknecht et al. | 164/480 |
| 4,949,777 | 8/1990 | Itoyama et al. | 164/453 |

FOREIGN PATENT DOCUMENTS

| | | | |
|---|---|---|---|
| 57-177863 | 11/1982 | Japan . | |
| 58-35047 | 3/1983 | Japan | 164/154.7 |
| 61-17344 | 1/1986 | Japan | 164/455 |
| 61-235046 | 10/1986 | Japan | 164/479 |
| 63-104754 | 5/1988 | Japan . | |
| 63-286255 | 11/1988 | Japan . | |
| 1-162544 | 6/1989 | Japan . | |
| 1-241364 | 9/1989 | Japan . | |
| 3-243250 | 10/1991 | Japan | 164/480 |
| 4-33754 | 2/1992 | Japan . | |

*Primary Examiner*—J. Reed Batten, Jr.
*Attorney, Agent, or Firm*—Sheridan Ross P.C.

[57] ABSTRACT

A continuous block caster has a temperature sensor in each of the chilling blocks. The sensor monitor and control temperatures of the chilling blocks in the casting direction (the "x-direction") and the direction transverse to the casting direction (the "y-direction").

28 Claims, 7 Drawing Sheets

APPARATUS FOR CONTINUOUSLY CASTING

FIELD OF THE INVENTION

The present invention relates to a method and apparatus for improving the quality of metal castings. More particularly, the present invention relates to a method and apparatus for controlling the heat extraction of molten metal being cast in a continuous caster.

BACKGROUND OF THE INVENTION

The continuous casting of molten metal into ribbons, strips, sheets and slabs has been achieved through a number of processes, including, roll casting, belt casting and block casting. As used herein, the term "metal" refers to any number of metals and their alloys, including without limitation, iron, aluminum, titanium, nickel, zinc, copper, brass and steel. In general, continuous casters comprise a continuously moving mold to which molten metal is supplied. The term "mold," as used herein, includes any system of rollers, belts or blocks which are used to define a casting region in a continuous caster. Heat transfer from the molten metal to the mold at the metal/mold interface results in solidification of the metal. Physical characteristics of the cast metal, such as thickness, can be determined during casting by, among other things, the contact time of the metal with the mold surface and the temperature differential across the metal/mold interface.

For example, in a typical continuous block casting process used in the production of aluminum strip, such as that described in U.S. Pat. No. 3,570,586, by Lauener, assigned to Lauener Engineering Ltd., the block caster mold includes two counter-rotating, endless block chains. The block chains are comprised of a number of chilling blocks, referred to herein as "blocks," which have been linked together. Each block chain is formed into an oval "casting" loop by placement on a track. As the blocks travel through the casting loop, the blocks in each chain are forced together in the casting region to form a flat plane, continuous mold. The block caster can further comprise a side dam system for preventing the metal being cast from escaping the mold by travelling in a direction transverse to the casting direction. In other embodiments, the blocks themselves may be designed with ridges to prevent molten metal from escaping the mold cavity. Heat transfer from the molten metal to the blocks results in solidification of the metal.

It is desirable when continuously casting molten metal to be able to control the quality of the metal being cast. The term "quality," as used herein, when referring to the metal being cast, refers to measurable characteristics of a metal cast, including, but not limited to, the number of surface imperfections in the cast, the microstructure of the cast, or the width and thickness of the cast. One method for controlling the quality of the cast in a continuous caster is to control the heat extraction rate of the metal being cast. The term "heat extraction rate," as used herein, refers to the rate of heat extraction from the molten metal in Watts. One way to control the heat extraction rate of the metal being cast is through cooling the mold surfaces in contact with the cast.

It can be difficult, however, to design a system for cooling a mold in a continuous caster because the mold is always in motion. Moreover, it can be difficult to control the complex, three-dimensional thermal loading of a mold. The cooling of mold surfaces should be carefully controlled to prevent undesirable thermal shocks and undesirable thermal loading of the mold from affecting the cast and causing unnecessary wear to the mold. Thermal shocks experienced by the mold as it cycles through the casting process and is repeatedly heated and cooled can cause fatigue stress resulting in premature wear of the mold, necessitating replacement. Moreover, undesirable thermal loading of the mold can cause residual heat to remain trapped in the mold. Residual heat remaining in the mold can prevent it from reaching its maximum heat extraction rate potential. Careful control of the mold cooling can reduce the formation of cold edge cracks in the cast. Careful control of the mold cooling can also prevent the formation of other imperfections that reduce the quality of a cast.

Several U.S. patents describe fluid cooling systems for use in continuous casters. For example, U.S. Pat. No. 4,934,444, by Frischknecht et al., and U.S. Pat. No. 3,570,583, by Lauener, both assigned to Lauener Engineering Ltd., disclose apparatus used in cooling molds of continuous casters. The apparatus consist of enclosures disposed in close relation to the molds, wherein cooling fluid is sprayed by nozzles to contact mold surfaces. The heated cooling fluid is collected in the enclosures and a vacuum atmosphere prevents cooling fluid from escaping from the enclosure. The mold surfaces can also be dried using forced air upon exiting the cooling enclosure.

U.S. Pat. No. 4,807,692, by Tsuchida et al., assigned to Ishikawajima-Harima Jukogyo Kabushiki Kaisha and Nippon Kokan Kabushiki Kaisha, discloses an apparatus for use in cooling the blocks of a continuous block caster. Tsuchida et al. disclose a cooling apparatus for blocks, wherein the blocks contain cavities which extend through their length in the direction transverse to the casting direction. A system of reciprocating nozzles aligned with the cavities in the blocks deliver cooling fluid to the blocks. The used cooling fluid is collected on the opposite side of the caster.

Known cooling systems typically use "flushing" processes for supplying cooling fluid to the heated mold surfaces. In a flushing process, large volumes of cooling fluid are brought into contact with the mold surfaces, typically by spraying the cooling fluid under pressure. Flushing processes alone, however are generally undesirable because such processes are difficult to control. For example, the cooling fluid can contain bubbles which contact the mold surface, creating uneven heat transfer across the mold/fluid interface. This can cause undesirable thermal shocking and undesirable thermal loading of the mold. Moreover, flushing systems are typically hand controlled and can be difficult to rapidly and repeatedly adjust in response to changes in the casting parameters, such as casting temperatures and cast quality, for example.

SUMMARY OF THE INVENTION

The present invention provides methods and apparatus for improving the quality of metal castings. The present invention provides methods and apparatus for cooling molten metal being cast in a continuous caster. The present invention provides methods and apparatus for controlling the thermal loading of a mold in a continuous caster. The present invention provides methods and apparatus which extend mold life in a continuous caster by reducing fatigue stress and premature wear of the surfaces of the mold. The present invention provides methods and apparatus for closed-loop control of the quality of metal being cast in a continuous caster.

In accordance with the present invention, apparatus are provided for cooling a mold used to solidify molten metal which utilize multiple cooling stages. Apparatus are also provided which allow control over the cooling of a movable mold in the casting direction (the "x-direction") and the direction transverse to the casting direction (the "y-direction").

In accordance with the present invention, apparatus are provided for measuring casting parameters for use in control of cooling, cleaning and coating of a mold in a continuous caster. Such casting parameters include mold temperatures, cast temperatures, melt temperatures, mold surface condition and cast quality.

In accordance with the present invention, apparatus are provided for cooling, cleaning and coating of a movable mold in a continuous caster. Mold cooling is preferably accomplished through contacting a thermally loaded mold surface with cooling fluid in droplet form. Such apparatus are capable of being automatically controlled to control cast quality without the need for human intervention.

In accordance with the present invention, methods are provided for use of the apparatus of the present invention. In particular, methods are provided for cooling, cleaning and coating a movable mold in a continuous caster. Moreover, methods are provided for controlling the cooling, cleaning and coating of a movable mold in a continuous caster. Such methods can be used for automatically controlling cast quality without the need for human intervention.

DETAILED DESCRIPTION

Figure 1:
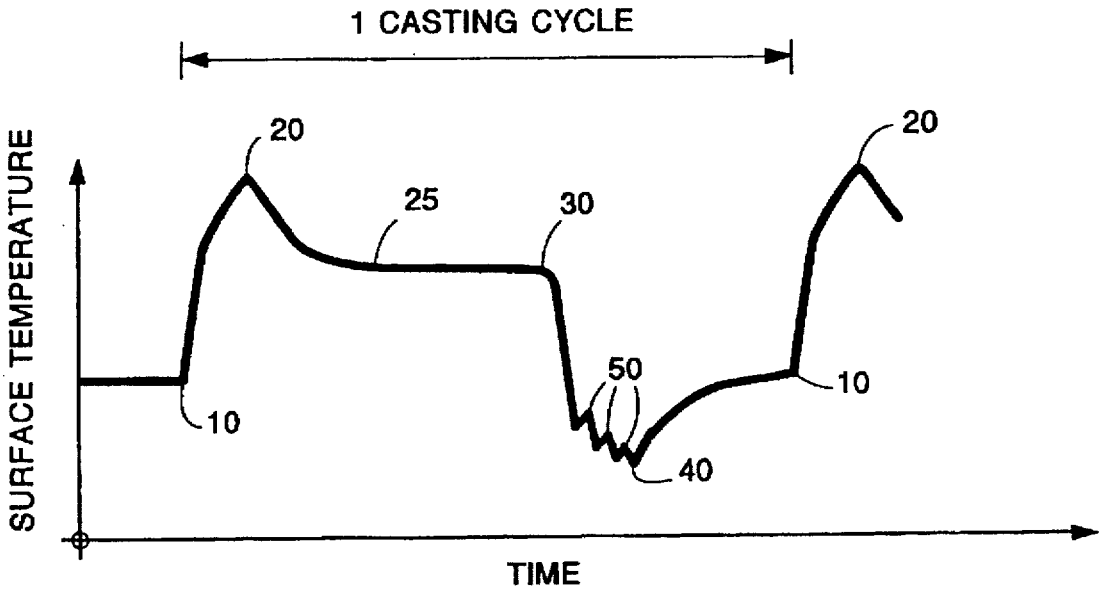
FIG. 1 is a graphical representation of the change in surface temperature of a chilling block in a known continuous block caster as it travels through a single casting cycle.

The present invention relates to novel methods and apparatus for increasing the quality of metal being cast in a continuous caster. As used herein, the term "metal" refers to any number of metals and their alloys, including without limitation, iron, aluminum, titanium, nickel, zinc, copper, brass and steel. The present invention also relates to novel methods and apparatus for decreasing mold wear in a continuous caster. In particular, the present invention relates to mold cooling methods and apparatus which provide for more uniform control of the thermal loading and reduced thermal shocking of the mold. The present invention can also include mold cleaning and coating methods and apparatus. In addition, the apparatus of the present invention can be capable of closed loop control.

Control of mold wear and the quality of metal being cast can be achieved through control of the mold cooling process used to solidify the metal cast. In general, to increase mold life, it is desirable to reduce thermal shocking, particularly at the mold's surface. In general, it is also desirable to control the thermal loading of the mold to allow the mold to reach its heat extraction rate potential by efficiently extracting heat throughout the mold.

Thermal shocking occurs when a mold experiences rapid changes in temperature, for example, as a result of molten metal contacting the casting surface of a mold. Thermal shocking can be most severe in the casting region and during cooling of the mold. Known cooling methods and apparatus can cause undesirable thermal shocking of the mold as the mold travels through the casting cycle. As used herein, the term "casting cycle" refers to one complete revolution of a casting loop. While thermal shocking cannot be completely eliminated, thermal shocking can be reduced to assist in preventing the formation of stresses in the mold which exceed the limits of the mold material properties, i.e., causing the formation of stress fractures in the mold surface, requiring that the mold be replaced.

Thermal shocking (and uneven thermal loading) in a mold can be observed as rapid fluctuations in the mold's surface temperature and as steep temperature profiles below the surface of the mold in the "z-direction", i.e., the direction normal to the casting surface of the mold. Thermal shocking has been observed to be the greatest, however, at the casting surfaces of the mold which interface with the molten metal in the casting region and the cooling fluid in the mold cooling system. In a typical casting cycle, a mold comes into contact with molten metal causing the surface temperature of the mold to rise sharply. As the mold travels through the casting region and is in contact with the solidifying metal, the surface temperature of the mold peaks and then begins to decrease. The thermal shock experienced by the mold surface when it first encounters the molten metal can be transmitted through the mold thickness, and becomes dampened as the thermal shock "wave" penetrates deeper into the mold in the z-direction. Thus the mold begins to warm throughout its thickness as it extracts heat from the molten metal. As the mold leaves the casting region, the mold surface begins to cool.

As the mold surface encounters the cooling region and is flushed with cooling fluid, the mold surface temperature rapidly decreases. The rapid decrease in mold surface temperature establishes another steep temperature profile in the mold extending from the surface of the mold through its thickness. As heat is extracted from the mold at its surface, the heat distribution in the mold below the surface changes to establish equilibrium. In known cooling apparatus which use a number of rows of nozzles to spray cooling fluid on the mold surface, the temperature of the mold surface has been observed to rise and fall sharply as the mold leaves one cooling zone established by one row of nozzles and begins to enter another cooling zone established by another row of nozzles. These thermal shocks can be detrimental to the mold, resulting in mold wear and mold surface cracking.

The subsurface, z-direction temperature profile in a mold, particularly in thicker molds, such as chilling blocks in a block caster, is three-dimensional. The temperature of a mold can be observed to vary in the casting direction (the "x-direction") as the mold travels through a casting cycle and alternately makes contact with the molten metal and the cooling fluid. The mold temperature also varies in a direction transverse to the casting direction (the "y-direction"). In particular, the temperature measured near the centerline of the mold surface can be generally higher than the temperature measured near the outer edges of the mold surface. This "horizontal" change in temperature with position in the y-direction can result in the undesirable cast quality, such as formation of varying microstructure in the cast in the y-direction. To the inventors' knowledge no known mold cooling system addresses the need to control cooling of the mold in a continuous caster in both the x-direction and the y-direction. Control over cooling of the exterior of the mold in the x-direction and the y-direction (along the casting surface) allows control over the thermal loading through the thickness of the mold, i.e. in the z-direction.

The temperature profiles of molds observed in known casters in the x, y and z-directions are indicative of uneven and inefficient thermal loading of the mold as the mold travels through the casting cycle. Because thermal shocks are transmitted from the interface of the casting surface through the thickness of the mold, it is difficult to completely eliminate uneven thermal loading. Thermal loading, however, can be controlled by controlling thermal shocks to reduce internal fatigue stresses generated in the mold, and to increase the potential of the mold for extracting heat from the cast.

The present invention includes a novel method and apparatus for reducing the rapid increases and decreases in temperature experienced at the block surface to reduce fatigue stresses developed in the mold, and to reduce block wear. In one embodiment of the present invention this can be accomplished by controlling the rate of heat transfer to the mold surface while it is in contact with the molten metal and controlling the rate of heat transfer from the mold during cooling. In addition, the amount of heat extracted by the mold during continuous casting and the amount of heat extracted from the mold during cooling can be controlled to achieve steady-state, continuous casting.

Heat transfer to and from a mold in a continuous caster can be complex as it is dependent upon numerous variables. In general, the heat extraction of a mold in a continuous caster can be controlled by manipulation of the temperature, composition and volume of the cooling fluid brought into contact with the mold surfaces.

The temperature of the cooling fluid can impact the rate of heat transfer which occurs when the cooling fluid is brought into contact with the mold surfaces. The greater the temperature difference across the mold/fluid interface, the greater the driving forces can be for heat transfer. While it can be desirable in some instances to achieve a large temperature differential across the mold/fluid interface, such large temperature differential can also result in undesirable thermal shocking of the mold. In general, it is desirable to promote a temperature differential which allows for rapid heat transfer, but which does not allow for heat transfer to occur at such a rate as to cause undue thermal stressing of the mold. For example, for many aluminum alloy continuous casting operations utilizing block casters, the temperature differential between the surface of the mold and the cooling fluid will be less than about a few hundred degrees centigrade. Such temperature differentials, however, can vary depending upon the continuous caster, mold geometry and metal being cast.

For controlling cooling fluid temperatures, the apparatus of the present invention can include a heater or similar device. In addition, the apparatus of the present invention can include devices such as valves or the like for controlling relative amounts of cooling fluid at different temperatures which can contact the mold. In a preferred embodiment of the present invention, such valves can be controlled to manipulate the temperature of the cooling fluid in both the x and y-directions along a mold's casting surface. Control over cooling of the exterior of the mold in the x-direction and the y-direction (along the casting surface) allows control over the thermal loading through the thickness of the mold, i.e. in the z-direction.

The rate of heat transfer from the mold surface to the cooling fluid can also be dependent upon the cooling fluid composition. In general, the cooling fluid used in the mold cooling stages can be any fluid which allows for substantially unimpeded heat transfer from the mold. In some applications, however, it can be desirable to use cooling fluids which retard heat transfer from the mold. Preferably, the cooling fluid should not be a material which can be easily ignited or combusted. Further, it is preferred that the cooling fluid be nontoxic, non-abrasive and non-corrosive for ease in handling and to prevent damage or wear to mold surfaces. The most commonly used cooling fluid is water, however, it is contemplated by the inventors that any number of fluids which possess the required cooling fluid characteristics can be used satisfactorily in the present invention. It is also contemplated that additives can be included in the cooling fluid which cad enhance or retard the ability of the fluid to transfer heat away from mold surfaces in the cooling region.

The rate of heat transfer can also be controlled by controlling the volume and form of delivery of the cooling fluid that comes into contact with the mold surfaces. In one embodiment of the present invention, the cooling fluid can be applied to the mold surface in droplet form rather than as a stream, such as in known cooling processes. While not intending the present invention to be constrained by theory, it is believed by the inventors that surprisingly, application of cooling fluid in droplet form reduces the average thermal stresses in a mold during cooling, reducing mold surface cracking, for example. On a microscopic scale, it is believed that contacting a mold's surface with cooling fluid in droplet form creates small zones of thermal stress, while leaving other, uncooled and unstressed zones which are not in contact with the cooling fluid. The combination of such stressed and unstressed zones results in an overall average thermal stress of the mold which can be less than that created by known cooling fluid flushing systems.

The average thermal stress experienced by the mold can be controlled, for example, through manipulation of cooling fluid droplet size, droplet distribution or the contact angle of the fluid with the mold surfaces. In general, to achieve favorable results, the diameter of the cooling fluid droplets can be below about 4 mm, and such droplets should be uniformly distributed across the mold surface. The droplet size used, however can depend upon the casting operation, and typically the droplet size will vary within a range for any particular casting operation. For example, in the casting of aluminum alloy slab utilizing a block caster, it has been found desirable to utilize droplet sizes within the range of about 50 microns to about 500 microns in diameter. Droplet sizes in excess of 4 mm, however, can be used successfully in the present invention depending upon, for example, the mold surface geometry and material and the type of metal being cast. As the temperature differential across the fluid/mold interface decreases during mold cooling, greater amounts of cooling fluid, i.e., fluid in larger droplet sizes or in streams under high pressure, or greater flowrates can be supplied to the mold surface without substantially increasing the average thermal stress experienced by the mold.

In one embodiment of the present invention, the heat extraction of the mold in a continuous caster can be accomplished gradually through the use of multiple cooling stages rather than in a large, single stage such as in known cooling systems. The use of multiple cooling stages can allow better control over cooling fluid temperature, volume, droplet size and contact angle. For control over mold cooling in the x-direction, each cooling stage can be independently manipulated to achieve a desired cooling effect.

A typical cooling stage in the present invention can include an enclosure containing an arrangement of nozzles or the like which deliver cooling fluid to the moving mold assembly in a continuous caster. Depending upon the requirements of each cooling stage, the cooling fluid can be provided at varying pressures and flowrates to the surfaces of the mold. Preferably, the stages can be designed to establish a substantially equal distribution of cooling fluid along the mold so that there are no uncooled gaps in which thermal shocks can form. In another embodiment, the cooling stages can be designed to control the rate of heat transfer along the X and y-directions of the mold surface, for example, by allowing independent control over fluid temperatures and flowrates in nozzles in the x and y-directions of a cooling stage. In addition to containment of the cooling fluid, the enclosures can also provide a means for collection of used cooling fluid, which can be cleaned, recycled and reused. The use of an enclosure also allows use of a vacuum atmosphere to collect water vapor created through cooling of the mold surface. Collection of water vapor can be important because it prevents the release of energy by the water vapor in changing phase to a liquid state from being transferred to fresh cooling fluid, which can reduce the effectiveness of the cooling system.

The various mold cooling stages can be placed in a variety of locations and configurations throughout the caster. In a typical continuous caster, however, such as a block caster having two horizontal casting loops, the cooling stages can be located opposite the casting region in both the upper and lower casting loops. The number of cooling stages used in a caster can depend, among other things, upon the type of continuous caster, the metal being cast and the desired amount of heat to be extracted from the mold during cooling.

Reduction in thermal shocking can also be achieved by controlling heat transfer between the mold surface and the molten metal in the casting region of the caster, as long as such control does not conflict with the heat transfer requirements for obtaining the desired cast quality. For example, in a block caster, subsequent to a chilling block leaving the cooling region, a coating can be applied to the surface of the block for controlling heat transfer from the molten metal to the block. The coating can retard heat transfer from the molten metal in contact with the blocks' surfaces to reduce thermal shocking. Such coatings should be non-combustible, have good adhesion to the mold surface, should be easy to apply to the mold surface, and should not substantially negatively impact cast quality. Preferably, such coatings can also be non-toxic, non-abrasive and non-corrosive for ease in handling and to prevent damage or wear to mold surfaces. In the continuous casting of aluminum using a continuous block caster, for example, it is known to apply an Edelweiss blackwash composition to the cooling fluid as a mold coating for slowing the rate of heat transfer along the mold/molten metal interface. The Edelweiss blackwash, which consists of an aqueous dispersion of amorphous, highly dispersed silicon dioxide ($SiO_2$) with about 1 percent of highly dispersed aluminum oxide ($AlO_2$), can be added to the cooling fluid and deposited on the casting surface of a chilling block as the block leaves the cooling region and the cooling fluid is evaporated or dried from the block surface.

A coating can also be applied to the mold after cooling using an atomizing sprayer or the like which can deposit the coating as a mist or fine dispersion of coating material particles, for example. As used herein, the term "fine" when referring to particle or droplet size refers to particles having a diameter of less than about 1.5 mm. For example, an air atomized sprayer can provide particles of coating material in the range of from about 30 microns to about 200 microns, and a pressure atomizing sprayer can provide particles of coating material in the range of from about 1 mm to about 100 microns. Other types of coating processes, however, including, but not limited to, roll coating, electrostatic coating, and other dry particle coating methods can also be used. Moreover, if a surface coating is applied to the mold, a drier or the like can be used for drying the coating on the mold surfaces. By impeding heat transfer, Edelweiss blackwash and other such coatings can reduce the rapidity at which the temperature at the mold surface rises, thereby reducing thermal shocking of the mold.

For control and monitoring of heat extraction of a continuous caster mold and the continuous cast produced, temperature sensing devices can be incorporated into the caster. The effectiveness of the cooling system in controlling thermal shocks and thermal loading of the mold can be monitored using temperature sensors, such as thermocouples and the like. For example, the total heat extracted from the cast by the mold can be calculated by measuring temperature changes throughout the mold during a casting cycle. Also, the cooling requirements for the caster can be calculated from such measurements. In this manner, the heat extraction rate of the molten metal can be maintained within an acceptable range of a desired heat extraction rate.

In order to measure mold temperatures as well as other temperatures throughout the caster, temperature sensing devices can be placed in both fixed and movable positions throughout the caster. For example, temperature sensors for monitoring cast temperatures can be placed in fixed positions at the exit points of the casting region. In addition, fixed temperature sensors can be placed at the entrance and exit points to each cooling stage to measure block temperature, and in the tundish to measure melt temperature. Thermistors or thermocouples, for example, can also be embedded in the rollers, belts or chilling blocks which comprise the movable mold in a continuous caster. Embedded temperature sensors are useful for measuring the temperature of the mold at various points in the z-direction and/or the y-direction throughout the mold. If embedded temperature sensors are used for temperature measurement, typically a telemetry device, such as a transmitter or the like, can be employed for receiving and transmitting the temperature measurements to a controller or operator for use in the control of the cooling process.

In a preferred embodiment of the present invention, temperature sensors can be placed in fixed positions throughout the caster and can be embedded in the mold itself. The number of temperature sensors used can vary depending, among other things, economic constraints and the information desired for controlling the casting operation. For example, for measuring temperatures in a continuous block caster having two horizontal casting loops, 9 fixed temperature sensors and 24 movable, embedded temperature sensors can be used in controlling mold cooling. In such a configuration, 3 fixed sensors measure the cast's surface temperature in the y-direction as the cast exits the casting region of the caster and the other 6 fixed position temperature sensors (3 for each of the two casting loops) can be used for measuring the surface temperature of blocks in the y-direction after the blocks exit the cooling stages. Typically, the 24 embedded temperature sensors (12 embedded in each of the two casting loops) are embedded in a single chilling block and/or support beam for measurement of temperatures in the y-direction and z-direction of the block and/or support beam.

In addition to controlling mold cooling, the present invention can include methods and apparatus for reducing mold wear and increasing cast quality through reducing the amount of unwanted matter and debris on surfaces of the mold that can come in contact with the molten metal being cast. Small amounts of debris can be deposited on the casting surface of the mold as part of the casting process. In some continuous casting processes, used mold coatings can leave debris on the casting surfaces of the mold. Unwanted matter on the casting surfaces of the mold can interfere with the heat transfer between the mold and the cast and/or cooling fluid and can cause surface imperfections in the cast. To substantially minimize reduction in cast quality due to the collection of unwanted matter on the casting surfaces of the mold, the mold surfaces should be kept substantially clean and relatively free of unwanted matter. Thus, the present invention can include methods and apparatus for control of unwanted matter on the casting surfaces of a mold in a continuous caster, i.e. one or more mold cleaning stages. A cleaning stage in a continuous caster can include, for example, one or more copper or brass brushes arranged in an enclosure to contact the casting surfaces of the mold to dislodge and contain undesired matter from the casting surfaces of the mold. Such cleaning stage can also include apparatus for providing fluid at high pressure to the casting surfaces of the mold and/or apparatus for vacuuming the mold surface for removing dislodged debris. Cleaning of the mold casting surfaces during operation of the caster can be accomplished in one or more stages separately from the mold cooling steps or can be integrated with one or more cooling stages. It is preferred however, that cleaning of the mold casting surfaces be integrated with one or more cooling stages, particularly if a high pressure fluid cleaning stage is used and any cleaning fluid used is the same as, or is compatible with the cooling fluid.

Cast quality monitoring and mold surface condition monitoring can be used to control the mold cooling and cleaning processes of the present invention. For example, the imperfections in the cast and the debris on mold surfaces can be monitored to determine the effectiveness of the cooling and cleaning apparatus. In response to measured cast quality and/or mold surface condition, determinations can be made whether to adjust the cooling and/or cleaning steps in the methods and apparatus of the present invention. In this manner, monitoring the quality of the cast allows for feedback control of the cooling and cleaning systems.

The quality of the cast can be visually or optically inspected as the cast exits the casting region of the caster. Many imperfections, such as surface porosity, inclusions and breakouts in a cast can be optically measured. The term "breakouts," as used herein, refers to a cast condition which can result from insufficient heat extraction resulting in cracks in the exterior of the cast through which molten metal can flow. The cast can be optically monitored, for example, by an operator of the caster who can view the surface of the cast as it exits the casting region of the caster. Alternatively, the cast surface can be optically measured as it exits the casting region using photographic or closed circuit video devices or the like. For example, a video camera can be used to optically examine the cast under both bright and dark fields as it exits the casting region of the caster. The images recorded by such camera can be digitized, such as through the use of a data processing device, and the microstructure and imperfections in the cast surface can be examined to determine the quality of the cast. The casting surfaces of the mold can be optically inspected in a similar manner for monitoring mold wear, such as surface cracking, or for the presence of unwanted debris. In a preferred embodiment of the present invention, the information obtained by measuring the cast quality or inspecting mold surfaces through optical or visual means can be used for feedback control of the continuous caster.

The number of optical monitoring devices used in a caster can depend upon numerous factors, including, for example, economic considerations. In one embodiment, at least about 1 video camera or the like can be used for optically monitoring the quality of the cast and/or inspecting the mold surfaces. In a preferred embodiment, a plurality of video cameras or the like can be used to monitor the quality of the cast and/or to monitor the surface condition of the mold. For example, in a continuous block caster having two horizontal casting loops, 2 video cameras can be used to optically measure the quality of the cast strip as it exits the casting region of the caster (one for each of the two major surfaces of the strip), and 2 video cameras (one for each of the two casting loops) can be used to monitor the surface condition of the chilling blocks.

The operation of the caster, including any cooling and cleaning apparatus, can be controlled from a controller device or the like. A typical controller suitable for use in the present invention can include a user interface, and a data processor, for example, a microprocessor. The controller can be capable of manual operation of the caster controls in response to user operator signals and automatic operation of the caster controls in response to the data processor. Data obtained by measuring casting parameters, such as cast quality and casting temperatures can be used in automated or manual control of the continuous casting operation. Moreover, a continuous stream of information can be received and manipulated by the microprocessor for controlling the operation of the caster. In a preferred embodiment, the control system can be capable of feedback control of the caster for modifying the quality of the cast. In a more preferred embodiment, the controller can be capable of closed-loop control of the caster, including, for example, the mold cooling apparatus.

In the method of the present invention, settings for caster controls can be manually preset to obtain a desired heat extraction rate from the molten metal in both the x-direction and the y-direction. As the caster is started, molten metal can be supplied from a tundish to a moving mold of a continuous caster. As the molten metal moves through the mold, sensors can measure the quality of the cast and various casting parameters, such as temperatures. The data obtained from such measurements can be received by a controller which can be capable of manipulating the data and altering caster controls to obtain a desired cast quality.

In one embodiment of the present invention, after the caster is placed into operation, optical inspections can be made of the cast surface and the surfaces of the mold. Data obtained from these inspections can be used to determine cast surface quality and mold surface condition. These measurements can be analyzed to determine if they are within acceptable ranges of desired values. If the cast surface quality and the mold surface condition are acceptable, the caster controls typically will remain unchanged. For example, the mold cleaning steps will not be modified if the amount of unwanted debris on the mold surfaces is acceptable.

If, after optical inspection, either the cast surface quality or the mold surface condition are not acceptable, a determination can be made, either by the caster operator or the data processor, whether the molten metal is castable. If the metal is not castable, for example, the molten metal cannot be solidified at a rate to prevent failure of the metal upon leaving the casting cavity, the casting operation can be halted. If the metal is castable, but requires that one or more casting parameters (i.e. heat extraction rate, etc.) be modified to obtain the desired product, the controller can alter the caster controls to obtain such casting parameters. For example, the heat extraction rate of the cast can be altered, such as, by changing the interface conditions where the molten metal contacts the casting surfaces of the mold. More particularly, in a continuous block caster, the Edelweiss blackwash coating on the casting surfaces of the chilling blocks can be modified to retard or increase heat transfer from the molten metal to the mold at the metal/mold interface.

In another embodiment of the present invention, temperatures can be measured throughout the caster for controlling the operation of the caster. In a preferred embodiment of the present invention, both optical and temperature measurements can be taken during casting for controlling the operation of the caster. For example, mold temperatures can be measured during casting in the x-direction (throughout the caster), the y-direction, and the z-direction (embedded in the mold). Temperatures can also be measured in the tundish, and at the cast surface as it exits the casting region. In general, the data gathered from the measurement of such temperatures provides information for controlling the operation of the caster. For example, slopes of temperature change curves (temperature profiles) can be calculated to determine if heat extraction of the cast or the mold through cooling are occurring too rapidly or too slowly.

If the measured cast quality is acceptable, the temperature data can be used to determine whether caster controls can be changed to improve the cast quality and mold cooling. For example, from the temperature measurements taken, the heat extraction requirements for mold cooling can be determined and calculated for each casting cycle in order to reach steady-state casting. To determine the total heat extracted from the cast or from the mold by the cooling system, a heat balance can be calculated which requires calculation of the heat flux. Determination of slopes of plotted temperature curves (temperature profiles) allow calculation of the heat flux using the following approximation if the thermal conductivity of the mold, i.e. the chilling block material in a block caster, is known:

$$\underset{(\text{Watts/m}^2)}{\text{Heat Flux}} = \underset{(\text{Watts/m/°C.})}{\text{Thermal Conductivity}} \times \underset{(\text{°C./m})}{\text{Temperature Slope}}$$

Also, average mold temperatures and trends in mold temperature changes can be tracked and analyzed as changes are made to the mold cooling system. Mean temperatures can be calculated to determine if over-heating or over-cooling of the mold is occurring. In this manner, the mold cooling control settings which provide the most desirable cast quality can be defined and tested through experimentation with various casting parameters. Such casting parameters include, but are not limited to, the metallostatic pressure in the tundish, the incoming molten metal temperature, the cooling fluid temperature, pressure or flowrate, the gap between the upper and lower mold surfaces, the mold surface condition and the mold speed of the caster.

If the slab quality is determined to be unacceptable, but castable, casting parameters can be modified. For example, mold cooling can be modified by changing the cooling fluid flowrate, temperature and/or composition flowing through individual nozzles (or rows or columns of nozzles) in one or more cooling stages. After changes are made to the caster controls as a result of measurements taken during casting, the cast quality and casting parameter measurements can be repeated after a period of time has passed to allow the changes to take effect in the quality of the cast exiting the casting region. This process can be repeated numerous times during the casting operation for controlling the caster and to obtain a desired cast quality. In this manner, the cast quality and temperature measurements can be used in closed-loop control of the caster.

Figure 2:
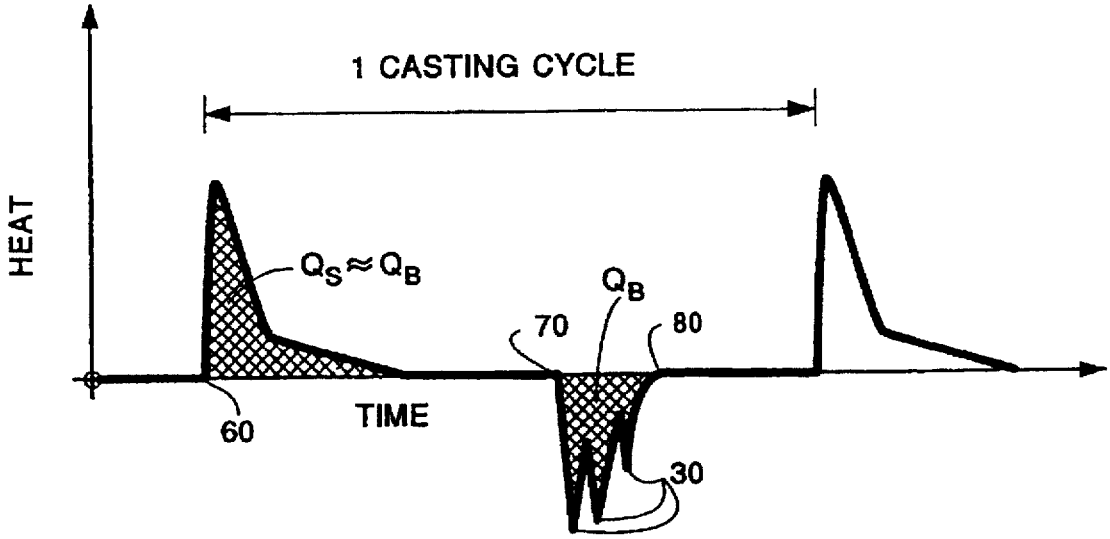
FIG. 2 is a graphical representation of the heat extraction obtained by a block in a single casting cycle using a known continuous block caster.

FIGS. 1 and 2 are illustrative of known cooling systems for continuous casters, in particular, block casters. FIG. 1 is a graphical representation of the surface temperature of a chilling block in a known block caster as a function of time as the block travels through one casting cycle. FIG. 2 is a graphical representation of the heat extraction of a chilling block in a known block caster as the block travels through one casting cycle.

In FIG. 1, a chilling block exits the cooling system of the caster and contacts molten metal at point 10, causing the block surface temperature to rise sharply until it reaches an apex at point 20. The temperature at the surface of the block slowly decreases from the apex at point 20 as the block travels through the casting region extracting heat from the molten metal and the molten metal becomes solidified. The block then leaves the casting region at point 25 and block temperature slowly drops until the block enters a cooling region at point 30, where it is contacted with cooling fluid, transferring heat from the block to the cooling fluid, causing a rapid drop in the surface temperature of the block. Between point 30 and the point where the block exits the cooling region at point 40, the formation of several temperature spikes 50 indicates that the block surface temperature rapidly rises and falls as the block travels between rows of nozzles spraying cooling fluid on the block in the cooling region. Temperature spikes 50 indicate that thermal shocking and stressing through uneven cooling is occurring in the block as the block moves toward equilibrium while moving through uncooled gaps between rows of nozzles in the cooling system.

In FIG. 2, the heat extraction curve for a chilling block undergoing thermal shocking through one casting cycle roughly corresponds to the temperature profile of the block surface as the block travels through one casting cycle. The crosshatched area $Q_S$ under the curve between points 60 and 70 indicates the total heat extracted (in Joules) from the molten metal by the block in the casting region. The crosshatched area $Q_B$ above the curve between points 70 and 80 indicates the total heat extracted by the cooling fluid from the block in the cooling region. Areas $Q_S$ and $Q_B$ are substantially equivalent indicating no total heat buildup in the caster during steady-state cooling. As used herein, the phrase "substantially equivalent" refers to approximate equivalency in value. For example, in a block caster, areas $Q_S$ and $Q_B$ are substantially equivalent, however, they are typically not exactly equivalent because of heat losses, such as those that occur as a result of the transfer of heat from the chilling blocks to the other parts of the caster. The spikes 90 in area $Q_B$ are indicative of thermal shocking experienced by the block while travelling through uncooled gaps between nozzles in the cooling system.

Figure 3:
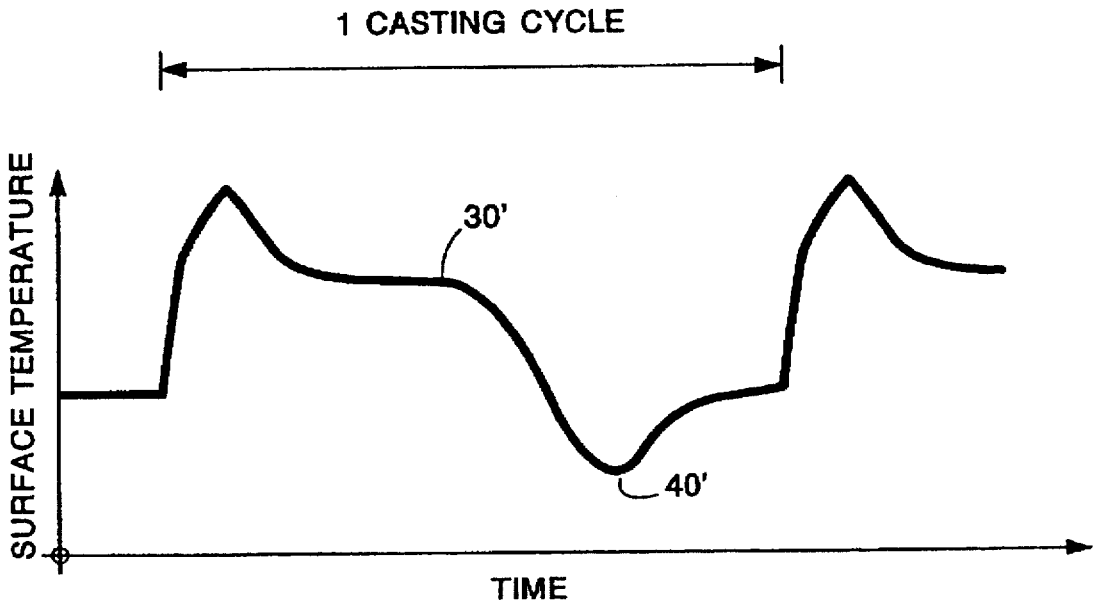
FIG. 3 is a graphical representation of the change in surface temperature of a chilling block in a continuous block caster using one embodiment of the present invention.
Figure 4:
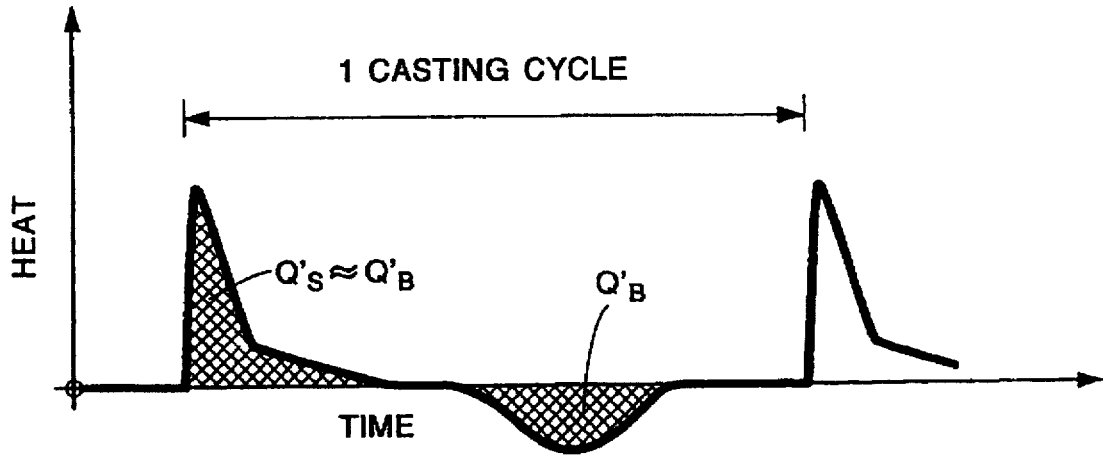
FIG. 4 is a graphical representation of the heat extraction obtained by a block in a single casting cycle using one embodiment of the present invention in a continuous block caster.

FIGS. 3 and 4 are illustrative of the reduced thermal shocking and improved control over thermal loading obtained by use of one embodiment of the method and apparatus of the present invention in a continuous block caster. FIG. 3 is a graphical representation of the surface temperature of a chilling block as the block travels through one casting cycle using one embodiment of the method and apparatus of the present invention. FIG. 4 is a graphical representation of the heat extraction achieved by a chilling block as the block travels through one casting cycle using one embodiment of the method and apparatus of the present invention.

FIG. 3 illustrates reduced thermal shocking of a block using one embodiment of the cooling system of the present invention. The present invention provides multi-stage cooling 30' over a greater range of the casting cycle, between points and 40'. The gradual cooling provided by one embodiment of the method and apparatus of the present invention between points 30' and 40' substantially eliminates thermal spikes caused by temperature fluctuations at the surface of the block in the cooling system. Thus, the thermal spikes 50 in FIG. 1 generated by known cooling systems no longer appear. Also, the control of the rate of heat transfer between the block and the molten metal and the block and the cooling fluid has reduced the rapidity in the temperature fluctuations of the block surface as evidenced by the smooth curve between points 30' and 40'.

FIG. 4 is an illustration of the effects one embodiment of the method and apparatus of the present invention can have on heat extraction. Because mold cooling in the present invention can be achieved more gradually than in known systems, heat can be extracted over a larger portion of the casting cycle. The total heat extracted (in Joules) by the cooling apparatus of the present invention $Q'_B$ is observed to be substantially equivalent to the total amount of heat extracted by the mold during casting $Q'_S$. This relationship indicates that steady-state cooling can occur using the method and apparatus of the present invention.

Figure 5:
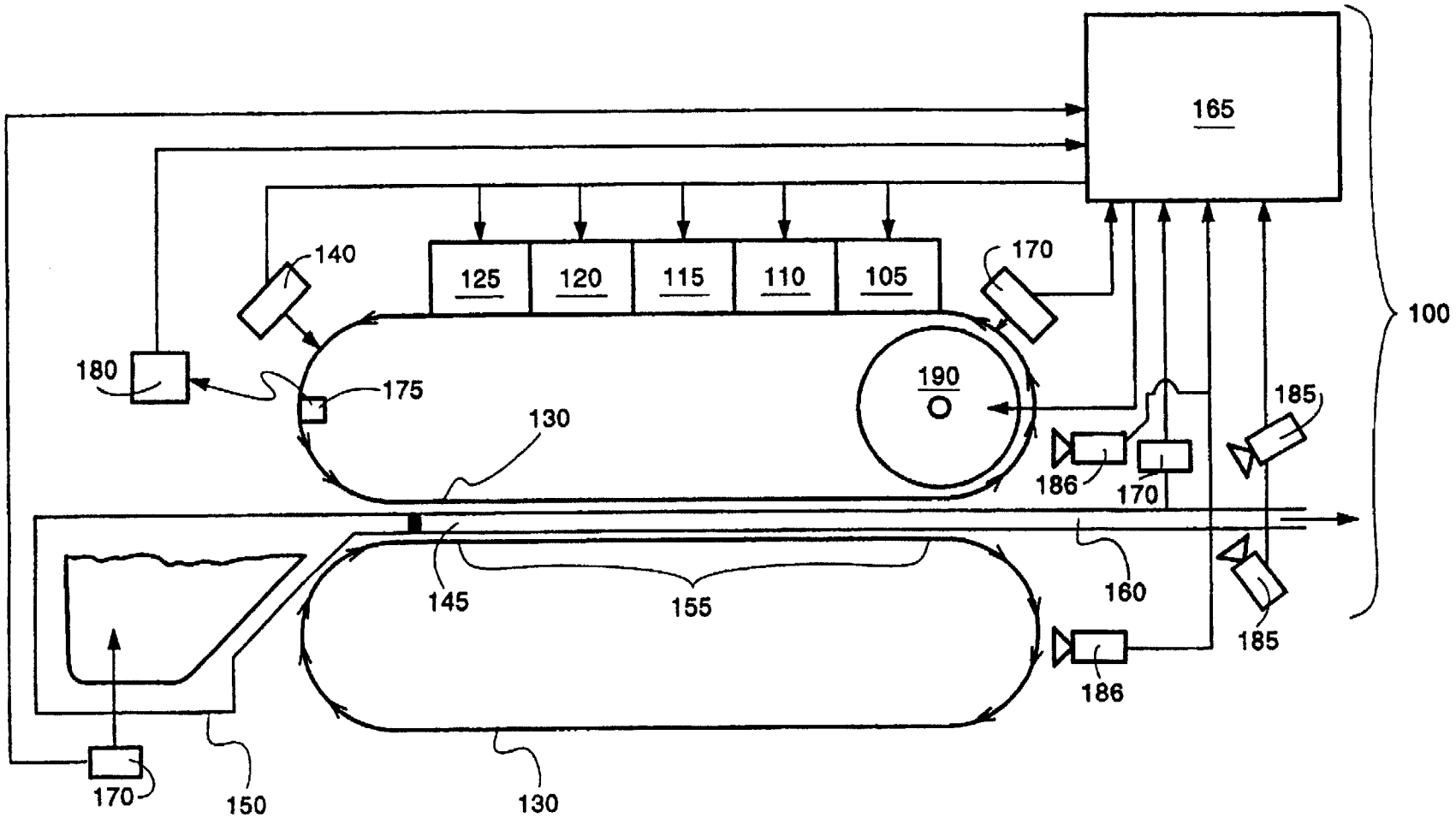
FIG. 5 illustrates one embodiment of the apparatus of the present invention for controlling the quality of a metal being cast in a continuous block caster.

The apparatus and interaction of the components of the apparatus of the present invention can be more readily understood by reference to FIG. 5. FIG. 5 is an illustration of one embodiment of the cooling and cleaning apparatus of the present invention in a continuous block caster having two horizontal casting loops, such as can be used in the production of aluminum strip. In continuous block caster 100, a plurality of cooling stages 105, 110, 115, 120, and 125 are used for cooling the blocks. As the mold blocks travel through the casting loop 130, they encounter the cooling stages. Each successive cooling stage increases the amount of cooling fluid, in this case water, that contacts the blocks. Thus, cooling stage 110 contacts the blocks with a greater volume of water than cooling stage 105, and cooling stage 115 contacts the blocks with a greater volume of water than cooling stage 110, and so forth. Cooling stage 105 also includes a cleaning stage, comprised of a dry brushing apparatus and a vacuum for removing the used Edelweiss blackwash coating and any other unwanted matter from the casting surfaces of the blocks. Cooling stage 125 includes a high pressure water spray for removing any leftover debris on the blocks. The Edelweiss blackwash coating apparatus 140, for example an atomizing sprayer, reapplies a fresh coating of Edelweiss blackwash each time a block is cleaned as it travels through the casting loop 130. As the blocks continue to travel through the casting loop 130, they contact molten metal 145 being poured from the tundish 150. The molten metal is formed into a strip 160 as the blocks are forced together to form a flat plane, moving mold in the casting region 155.

The system controller 165 receives data from a plurality of fixed position 170 temperature sensors which are electronically linked to controller 165. The system controller also receives data from temperature sensors 175 embedded in the blocks. The data obtained by the embedded temperature sensors 175 are preferably transmitted to the controller through a telemetry unit 180 which is electronically linked to controller 165. Quality of the cast is also measured optically by cameras 185 as the cast strip 160 exits the casting region 155. The condition of the casting surfaces of the chilling blocks can be examined using cameras 186. This information is transmitted to controller 165. After receipt of data from the various sensors 170, 175, 185 and 186, the controller 165 is capable of manipulating the controls of the caster to modify the quality of the strip 160 being cast. For example, the controller 165 is capable of manipulating, among other things, cooling of the blocks in the x-direction and y-direction by controlling the cooling and cleaning stages 105, 110, 115, 120, 125, the caster drive systems 190, the pouring of the metal from the tundish 150, and the block coating application 140. The controller 165 can be capable of substantially immediate response to the strip quality measurements in manipulating the controls of the caster, such as in the case of closed-loop control of the caster.

Figure 6:
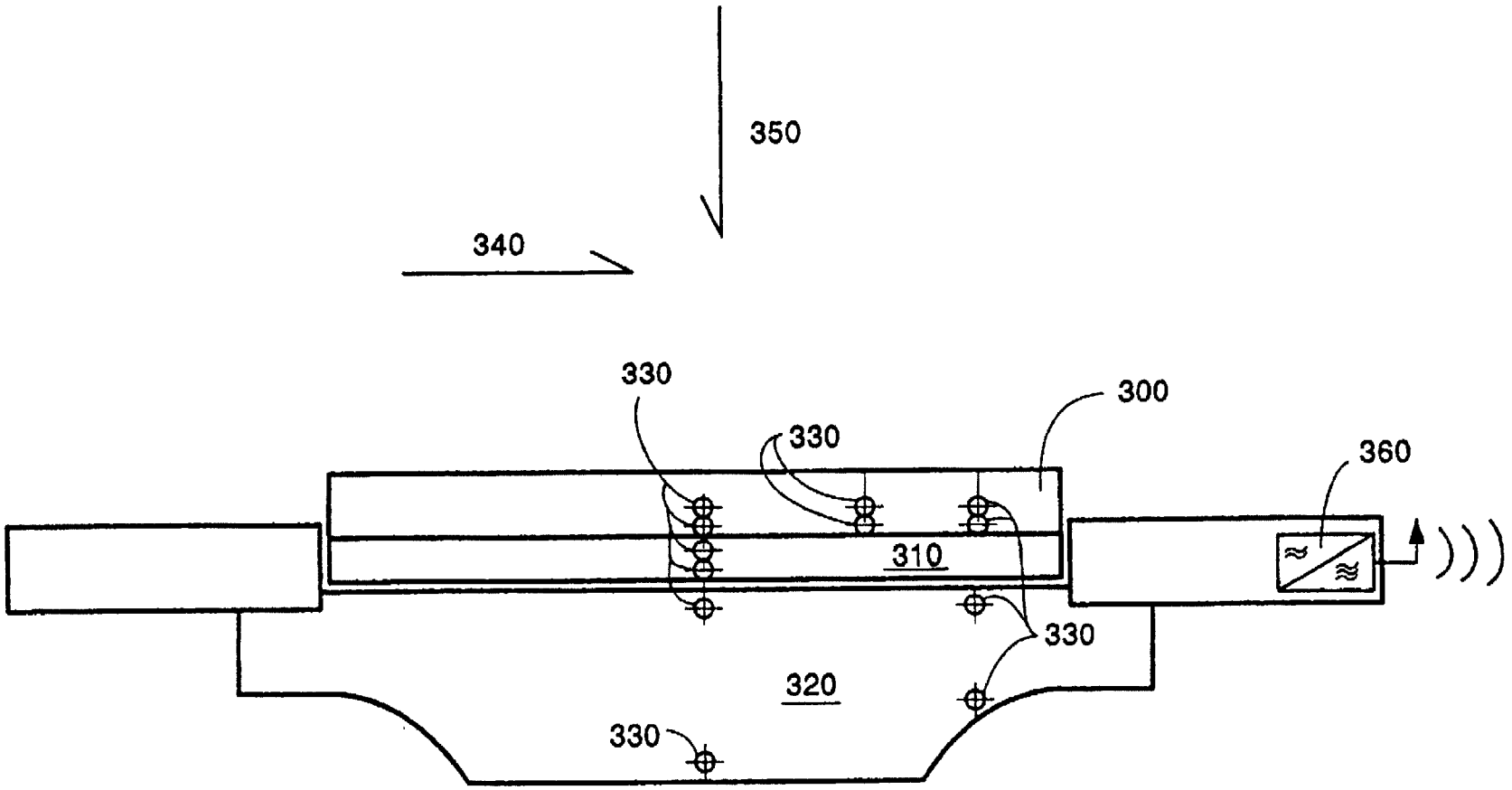
FIG. 6 illustrates one embodiment of the present invention directed to placement of temperature sensors embedded in a chilling block of a continuous block caster.

The placement of embedded temperature sensors in one embodiment of the apparatus of the present invention can be more readily understood by reference to FIG. 6. FIG. 6 is an illustration of a cross section of a block assembly, consisting of a chilling block 300 and a block holding plate 310, and a support beam 320, such as are used in a block chain of a continuous block caster. The imbedded temperature sensors 330 can be distributed throughout the block assembly and the support beam as shown in the y-direction 340 and the z-direction 350. A telemetry device 360 can be included in a flange on the support beam for transmitting the temperature measurement data obtained from the imbedded temperature sensors to a controller or the like. The number and placement of the temperature sensors can be modified depending upon the requirements necessary for monitoring and controlling the cooling process.

Figure 7A:
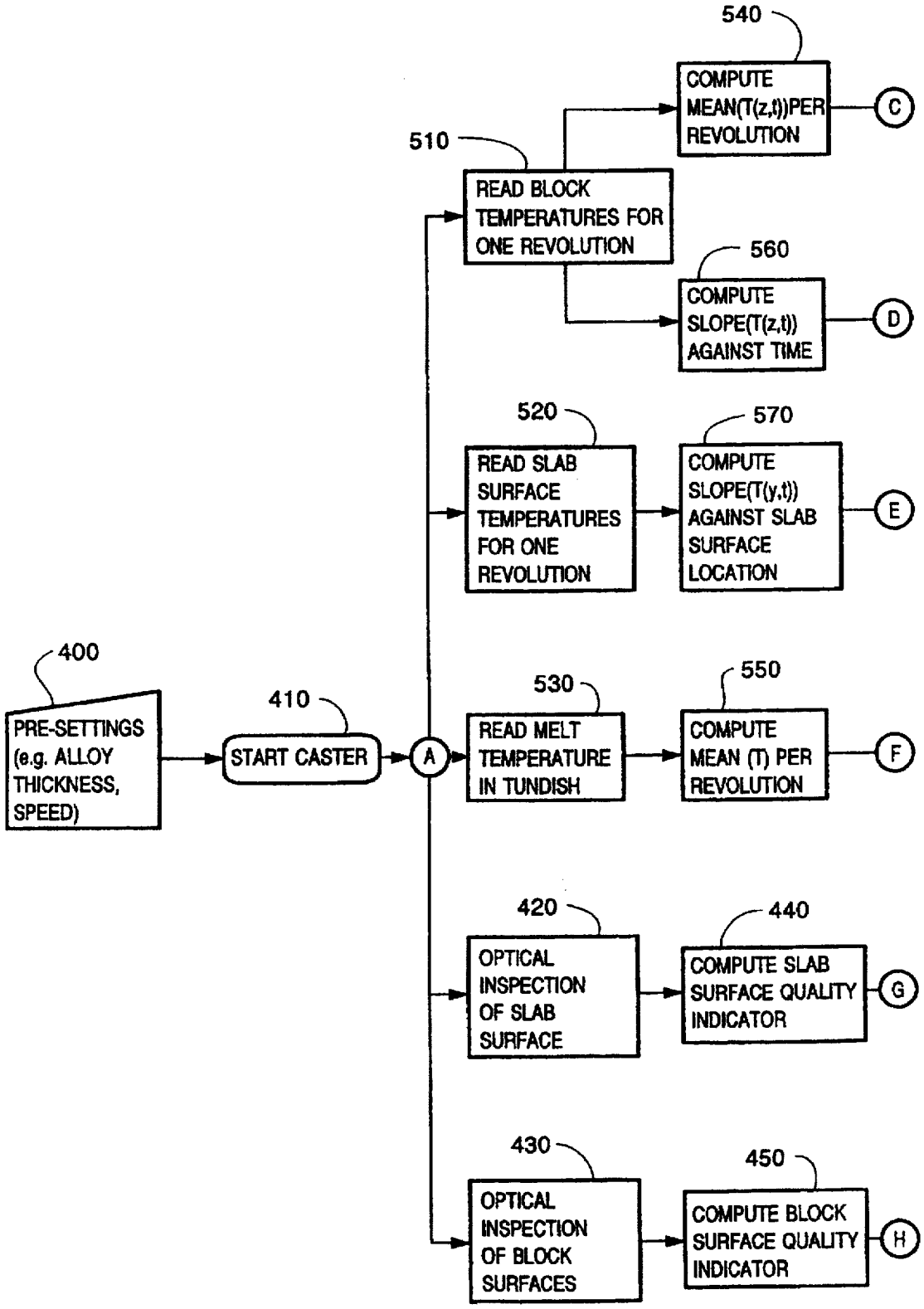
FIGS. 7*a* through 7*c* are a block diagram illustrating one embodiment of the method of the present invention for controlling the quality of metal being cast.
Figure 7B:
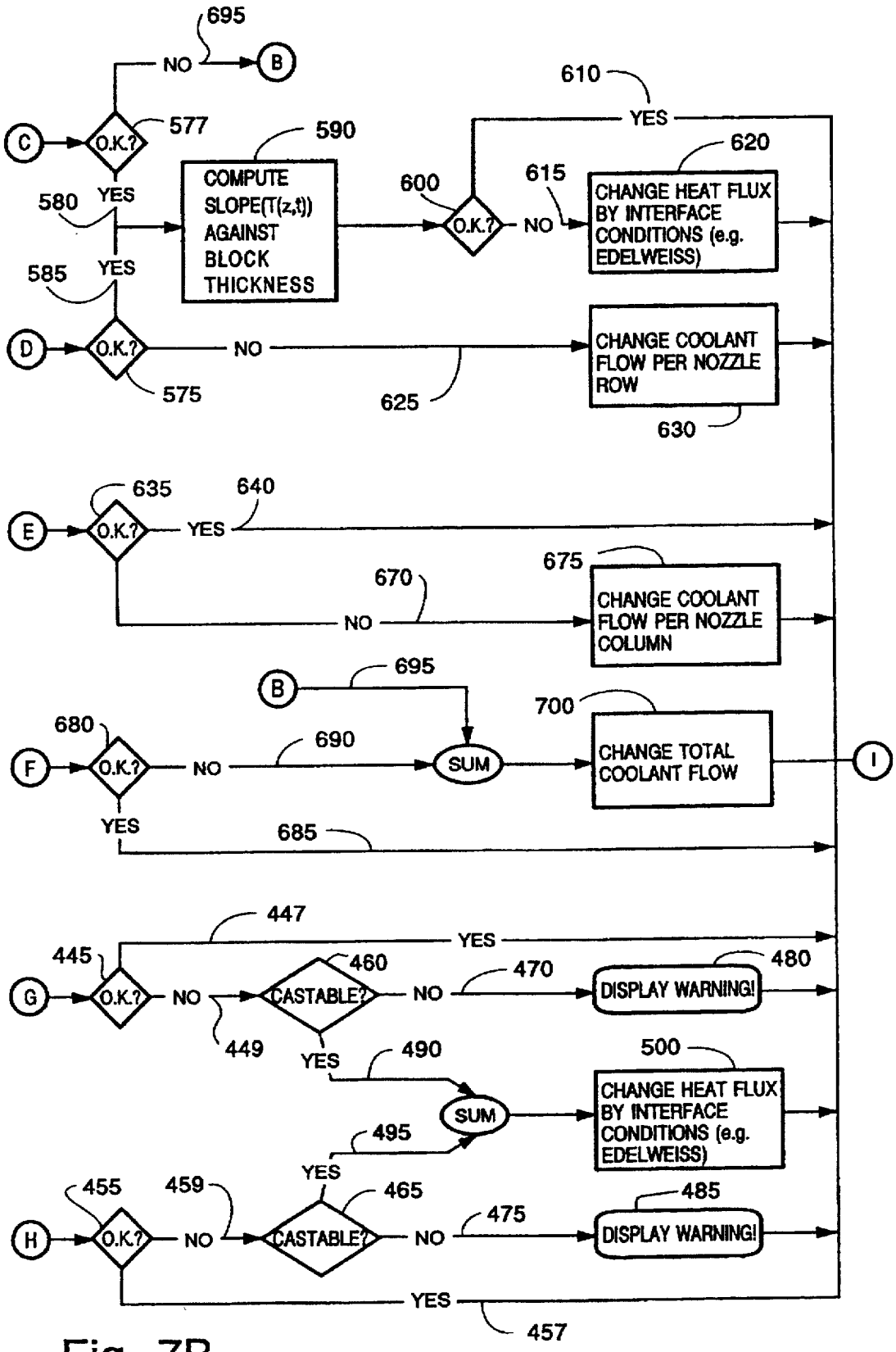
Figure 7C:
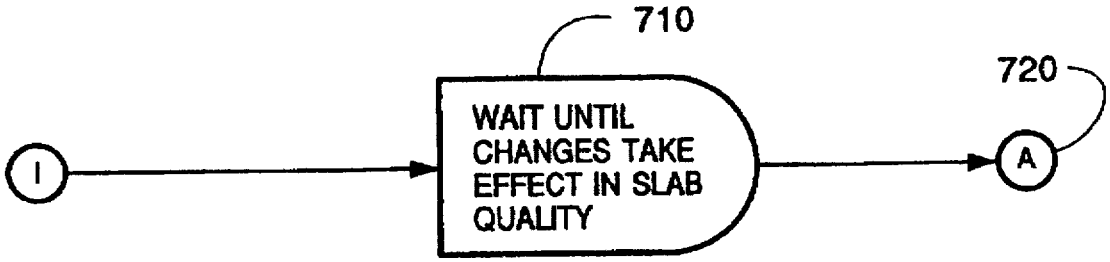

The methods and interaction of steps in the methods of the present invention can be more readily understood by reference to FIGS. 7*a* through 7*c*. FIGS. 7*a* through 7*c* are a block diagram of one embodiment of the methods of the present invention for controlling mold cooling and cleaning in a continuous block caster. Desired casting parameters and initial caster control settings, such as caster speed and the flowrate of metal being poured from the tundish, can be input 400 by an operator into the caster controller. The caster can then be started 410 and will begin to produce a continuous casting using the initial caster settings. Simultaneously, casting parameters, such as casting temperatures and cast quality, can be measured for use in controlling the casting operation.

Optical inspection of the cast slab 420 and block surfaces can be performed to determine the slab surface quality 440 and block surface condition 450. From the cast slab quality and block surface condition measurements, determinations 445 and 455 can be made whether the cast slab is within an acceptable range of the desired cast quality. If the cast quality is acceptable 447, 457, then the caster controls will typically remain unchanged unless other measured casting parameters require that a change be made, or if experimentation with caster controls is desired to obtain a more preferable cast quality. If either the cast quality or the mold surface condition is unacceptable 449, 459, determinations must be made whether the molten metal is castable 460, 465. If the cast is determined to be uncastable 470, 475, for example, the cast fails upon leaving the casting region, a warning signal can be displayed to the caster operator 480, 485, and the casting operation can be terminated. If either the cast quality or the mold surface condition is unacceptable 449, 459, however the cast is determined to be castable 490, 495, the casting parameters, such as the rate of heat transfer can be altered. For example, the heat extraction rate can be altered as shown by changing interface conditions, such as the application of a surface coating to the chilling blocks 500. As another example, high pressure cleaning fluid spray in the cleaning system can be activated to reduce the amount of unwanted debris on the block surfaces (not shown).

Concurrently with optical measurements 420 and 430, block temperatures 510, cast slab surface temperatures 520, and melt temperature in the tundish 530, can be measured for one casting cycle. If the cast quality is acceptable, i.e. within a range of the desired cast quality, the various measured temperatures can be used to track and calculate trends or monitor changes in the cast, such as those which occur with a change in the caster controls. The phrase "mean temperature", as used herein, refers to the mean temperature determined for each casting cycle. For example, the mean temperature of a block for a given position inside the block can be computed 540, the mean temperature of the melt can be computed 550, the slope of the plotted curve of measured temperatures for a given position inside a block versus time 560, and the slope of the plotted curve of measured temperatures for a given position on the slab surface versus position in the y-direction 570, can be calculated.

The computed values for the mean temperature of a block 540, and the slope of the plotted curve (or heat balance obtained therefrom) 560 can be analyzed and compared to data obtained from previous casting cycles 575, 577. If such analyses 575, 577, reveals no undesirable trends or changes 580, 585, for example, no over-cooling or over-heating of the mold, then the slope of the plotted curve of measured temperatures for a given position inside a block versus position in the z-direction 590 can be calculated. If such analysis 600 reveals no undesirable trends or changes in the data received (or heat balance obtained therefrom) 610, the caster controls will typically remain unchanged unless other measured casting parameters require a change be made, or if experimentation with caster controls is desired to obtain a more preferable cast quality. If through analysis 600, the slope of the plotted curve (or heat balance obtained therefrom) 590 exhibits an undesirable trend 615, the casting parameters, such as the rate of heat transfer can be altered. For example, the heat extraction rate can be altered as shown by changing interface conditions, such as the application of a surface coating to the chilling blocks 620.

If through analysis 575, the slope of the plotted curve (or heat balance obtained therefrom) 560 exhibits an undesirable trend 625, the casting parameters, such as the cooling of the block in the x-direction can be modified. For example, the flowrate of cooling fluid per nozzle, or row of nozzles in the x-direction in one or more cooling stages can be altered 630.

The computed values for the slope of the plotted curve (or heat balance obtained therefrom) 570 can be analyzed and compared to data obtained from previous casting cycles 635. If such analysis 635 reveals no undesirable trends or changes in the data received (or heat balance obtained therefrom) 640, the caster controls will typically remain unchanged unless other measured casting parameters require a change be made, or if experimentation with caster controls is desired to obtain a more preferable cast quality. If through analysis 635, the slope of the plotted curve (or heat balance obtained therefrom) 570 exhibits an undesirable trend 670, the casting parameters, such as the cooling of the block in the y-direction in one or more cooling stages can be modified. For example, the flowrate of cooling fluid per nozzle, or column of nozzles in the y-direction in one or more cooling stages can be altered 675.

The computed values for the mean melt temperature 550 can be analyzed and compared to data obtained from previous casting cycles 680. If such analysis 680 reveals no undesirable trends or changes in the data received 685, the caster controls will typically remain unchanged unless other measured casting parameters require a change be made, or if experimentation with caster controls is desired to obtain a more preferable cast quality. If through analysis 680, the mean melt temperature 650 exhibits an undesirable trend 690, for example, large, rapid temperature fluctuations, and if through analysis 577, mean block temperature 540 exhibits an undesirable trend 695, for example, over-heating of the mold, the casting parameters, such as the cooling of the block can be modified. For example, the total flowrate of cooling fluid in one or more cooling stages can be altered 700.

After the changes in the casting operation have been conducted, new cast quality and temperature measurements can be taken after a period of time to allow the changes in the caster controls to take effect in the slab quality 710. If additional changes are needed, the casting parameters can be repeatedly altered in response to the measured casting parameters to obtain the desired cast quality 720.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. An apparatus for cooling metal being cast in a continuous block caster comprising:

(a) a movable mold comprising a plurality of chilling blocks having a casting region and a separate cooling region;

(b) means for monitoring temperature during casting of said metal, said means capable of sending a signal corresponding to said temperature and wherein said means for monitoring temperature includes temperature sensors embedded in said mold designed to measure the temperatures of said mold in both the x- and y-directions;

(c) means for cooling said mold comprising means for contacting the exterior of said mold with cooling fluid in said separate cooling region and wherein said means for cooling comprises individual nozzles arranged in rows and columns in said x- and y-directions; and (d) means for:

(i) receiving a signal sent from said means for monitoring temperature; and (ii) automatically controlling said means for cooling said mold in response to said signal, wherein said means for automatically controlling said means for cooling includes means for adjusting at least one of the cooling fluid flowrate, cooling fluid temperature and cooling fluid composition flowing through at least two of said individual nozzles in order to provide the ability to control temperatures of said mold in said x- and y-directions.

2. An apparatus as claimed in claim 1, wherein said means for monitoring temperature comprises at least one fixed position temperature sensor.

3. An apparatus as claimed in claim 1, comprising means for optical monitoring of the quality of said cast.

4. An apparatus as claimed in claim 1, comprising means for optical monitoring of the surface condition of said mold.

5. An apparatus as claimed in claim 4, wherein said means for optical monitoring comprises a video camera.

6. An apparatus as claimed in claim 1, comprising means for cleaning said mold.

7. An apparatus as claimed in claim 6, comprising means for controlling said means for cleaning said mold.

8. An apparatus as claimed in claim 1, wherein said means for receiving a signal and automatically controlling said means for cooling said mold comprises a controller.

9. An apparatus as claimed in claim 8, wherein said controller comprises a data processor capable of closed-loop control of said cooling of said mold.

10. An apparatus as claimed in claim 8, wherein said controller is capable of controlling the cooling of said mold in the x-direction.

11. An apparatus as claimed in claim 8, wherein said controller is capable of controlling the cooling of said mold in the y-direction.

12. An apparatus as claimed in claim 8, wherein said controller comprises a microprocessor.

13. An apparatus as claimed in claim 1, comprising means for applying a coating for controlling heat transfer from said metal to said movable mold.

14. An apparatus as claimed in claim 13 wherein said coating for controlling heat transfer is an aqueous dispersion of highly dispersed silicon dioxide and aluminum dioxide.

15. An apparatus as claimed in claim 1, wherein said metal being cast comprises aluminum.

16. An apparatus as claimed in claim 1, wherein said means for monitoring temperature comprises a thermocouple.

17. An apparatus as claimed in claim 1, wherein said metal being cast comprises steel.

18. An apparatus as claimed in claim 1, wherein said metal being cast comprises copper.

19. An apparatus as claimed in claim 1, wherein said metal being cast comprises brass.

20. An apparatus as claimed in claim 1, wherein said means for cooling said mold comprises multiple cooling stages.

21. An apparatus as claimed in claim 1, wherein said means for contacting the exterior of said mold with cooling fluid comprises means for providing cooling fluid to said mold in droplet form.

22. An apparatus as claimed in claim 21, wherein said means for providing cooling fluid to said mold in droplet form comprise nozzles.

23. An apparatus as claimed in claim 21 wherein said cooling fluid in droplet form comprises droplets having a diameter of less than about 4 millimeters.

24. An apparatus as claimed in claim 21 wherein said cooling fluid in droplet form comprises droplets having a diameter within the range from about 50 microns to about 500 microns.

25. An apparatus as claimed in claim 1 wherein cooling is controlled in the x-direction by providing multiple cooling stages spaced apart in the x-direction and wherein at least two of said cooling stages can be independently controlled to achieve the desired cooling in said x-direction.

26. An apparatus as claimed in claim 1 wherein cooling is controlled in the y-direction by providing multiple cooling stages spaced apart in the y-direction and wherein at least two of said cooling stages can be independently controlled to achieve the desired cooling in said y-direction.

27. An apparatus as claimed in claim 1 wherein said means for monitoring temperature comprise a plurality of temperature sensors embedded in at least one chilling block and placed so as to measure temperatures in the y-direction and z-direction of said block.

28. An apparatus as claimed in claim 1 wherein the temperature of said cooling fluid is controlled.

* * * * *